US011103050B2

(12) United States Patent
Lopez

(10) Patent No.: US 11,103,050 B2
(45) Date of Patent: Aug. 31, 2021

(54) HAIR-SHAVINGS COLLECTING SHEET

(71) Applicant: Randall Lopez, Austin, TX (US)

(72) Inventor: Randall Lopez, Austin, TX (US)

( * ) Notice: Subject to any disclaimer, the term of this patent is extended or adjusted under 35 U.S.C. 154(b) by 57 days.

(21) Appl. No.: 16/534,118

(22) Filed: Aug. 7, 2019

(65) Prior Publication Data

US 2020/0046104 A1 Feb. 13, 2020

Related U.S. Application Data

(60) Provisional application No. 62/715,864, filed on Aug. 8, 2018.

(51) Int. Cl.

| | |
|---|---|
| ***A45D 44/16*** | (2006.01) |
| ***A47K 1/06*** | (2006.01) |
| ***A45D 27/00*** | (2006.01) |
| ***A47K 1/14*** | (2006.01) |

(52) U.S. Cl.

CPC ..... *A45D 44/16* (2013.01); *A45D 27/00* (2013.01); *A47K 1/06* (2013.01); *A47K 1/14* (2013.01)

(58) Field of Classification Search

CPC ..... A47K 1/06; A47K 1/14
USPC ..... 4/286
See application file for complete search history.

(56) References Cited

U.S. PATENT DOCUMENTS 2,876,471 A * 3/1959 Kraemer ..... A47K 1/06 15/1
6,550,639 B2 * 4/2003 Brown ..... A47L 13/40 15/1.52
2010/0325791 A1 * 12/2010 Davidowitz ..... A47K 1/06 4/655
2015/0059073 A1 * 3/2015 Ciriclio ..... A47K 13/14 4/245.5
2016/0032573 A1 * 2/2016 Gavin ..... E03C 1/186 4/654

(Continued)

FOREIGN PATENT DOCUMENTS

JP 2013111313 A 6/2013

OTHER PUBLICATIONS

Degradable Stretch Wrap, United States Plastic Corp., n.d., [online], [retrieved on Jun. 20, 2018]. Retrieved from the Internet <https://www.usplastic.com/catalog/item.aspx?itemid=97735>.

(Continued)

*Primary Examiner* — Christine J Skubinna
(74) *Attorney, Agent, or Firm* — Craige Thompson; Thompson Patent Law; Timothy D. Snowden

(57) ABSTRACT

Apparatus and associated methods relate to a hair-shavings collecting sheet that includes at least four peel-back adhesives, in an exemplary embodiment, in each corner on the surface of one side of the sheet to releasably couple the sheet to a surface, such as a bathroom sink, where the adhesive may be optional for use due to the peel-off cover on the adhesives. In an illustrative example, the sheet may be formed of a polymer and made of (oxo-) biodegradable or recycled materials. The sheet may include multiple different adhesive locations disposed around the sheet, for example. In some implementations, the adhesive may have complementary release liners. A sheet with adhesive may securely but releasably keep the sheet in place, thus preventing spillage of shaved hair.

18 Claims, 5 Drawing Sheets

(56) References Cited

U.S. PATENT DOCUMENTS

2019/0150674 A1* 5/2019 Grinberg ..... B65F 1/1415

OTHER PUBLICATIONS

Biodegradable Plastic free & Chemical free Paper Tape 2 Inch with Natural Glue—set of 5 rolls, Recycle.Green, n.d., [online], [retrieved on Jun. 20, 2018]. Retrieved from the Internet <https://www.recycle.green/products/paper-tape-1-5-inch-with-natural-glue>.

AtHomeBarber, AtHomeBarber® Disposable Plastic Sink Covers for Easy Clean Up When Cutting Hair Over the Bathroom Sink, Amazon, Jan. 2, 2016, [online], [retrieved on Jun. 20, 2018]. Retrieved from the Internet <https://www.amazon.com/AtHomeBarber%C2%AE-Disposable-Plastic-Cutting-Bathroom/dp/B01A2Y0HCE>.

Clean Cover Hair Mat, Clean Cover Hair Mat: Cut Hair, Shave, Apply Makeup or Hair Dye Over Bathroom Sink, Amazon, n.d., [online], [retrieved on Jun. 20, 2018]. Retrieved from the Internet <https://www.amazon.com/Clean-Cover-Hair-Cut-Kit/dp/B01BLUSON2?th=1>.

Clean Cover Hair Mat, Good Day, 2015, [online], [retrieved on Jun. 20, 2018]. Retrieved from the Internet <https://gooddaysacramento.cbslocal.com/video/3333275-clean-cover-hair-mat/>.

VELCRO® Sticky Fix Tak, Removable, 86 Squares/Pk, Staples, n.d., [online], [retrieved on Jun. 20, 2018]. Retrieved from the Internet <https://www.staples.com/velcro-sticky-fix-tak-removable-86-squares-pk/product_2633791>.

* cited by examiner

HAIR-SHAVINGS COLLECTING SHEET

CROSS-REFERENCE TO RELATED APPLICATIONS

This application claims the benefit of U.S. Provisional Application Ser. No. 62/715,864, titled "Hair-Shavings Collecting Sheet," filed by Randall Lopez on Aug. 8, 2018, the entire contents of which are incorporated herein by reference.

TECHNICAL FIELD

Various embodiments relate generally to cleaning up hair-shavings.

BACKGROUND

In the modern world, many people shave off unwanted body hair to maintain a clean, aesthetically pleasing look. Men may shave their facial hair, and women may shave their leg hair, using razors or electrical shavers, for example. Shaving hair may be more common in some parts of the world than in other parts of the world.

SUMMARY

Apparatus and associated methods relate to a hair-shavings collecting sheet that includes at least four peel-back adhesives, in an exemplary embodiment, in each corner on the surface of one side of the sheet to releasably couple the sheet to a surface, such as a bathroom sink, where the adhesive may be optional for use due to the peel-off cover on the adhesives. In an illustrative example, the sheet may be formed of a polymer and made of (oxo-) biodegradable or recycled materials. The sheet may include multiple different adhesive locations disposed around the sheet, for example. In some implementations, the adhesive may have complementary release liners. A sheet with adhesive may securely but releasably keep the sheet in place, thus preventing spillage of shaved hair.

Various embodiments may achieve one or more advantages. For example, a hair-shavings collecting sheet may reduce the mess from shaving by making post-shaving cleanup faster and easier. Some embodiments may provide for an eco-friendly hair-shavings collecting sheet that gives users a clear conscience knowing that they are not contributing to human pollution and waste. The sheet may be effective in collecting and attracting shaved hair, which may appease, for example, the spouse of the shaving person (e.g., since there is minimal mess left after shaving). Multiple sheets may be easily attached to one another, thus allowing the shaving coverage area to be customized for shaving over different size surfaces (e.g., a sink vs. a floor). In some examples, the sheet may have portions (e.g., such as the edges/corners of the sheet) that may come in a pre-formed shape to aid in attaching the sheet to a surface. A sheet may include upwardly shaped flaps that form a bowl or valley for hair-shavings to fall into, for example.

Some embodiments may include a dispenser that contains a roll or stack of sheets. The dispenser may include a frictional element that imparts static charge on a sheet as it is dispensed from the dispenser or the sheets may already include a static charge to them. Once the sheet has been used, it can be folded or bunched up inward, keeping the hair clippings enclosed and then can be used to gently wipe any excess hair that may have gotten on the surface, with the aid of the static charge. Various embodiments may include the sheet as part of a kit that includes other shaving-related items (e.g., towel, nose trimmers, etc.).

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
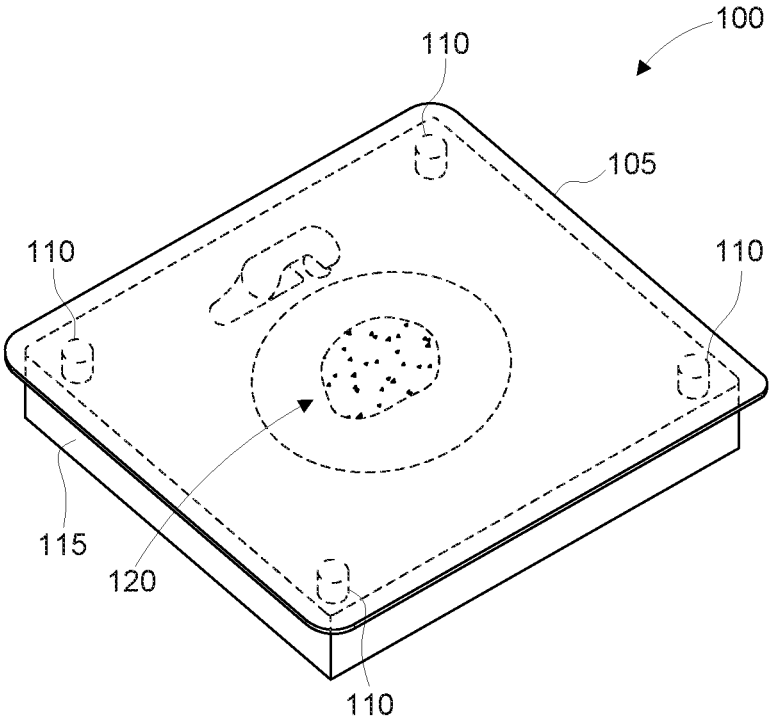
FIG. 1 depicts a perspective top view of an exemplary hair-shavings collecting sheet deployed on a bathroom sink.

FIG. 1 depicts a perspective top view of an exemplary hair-shavings collecting sheet deployed on a bathroom sink. An exemplary deployment scenario 100 includes a hair-shavings collecting sheet 105. The sheet 105 has a plurality of adhesive spots 110 coupled to a bottom side of the sheet 105. In this exemplary depiction, the sheet 105 is a rectangular shape with one adhesive spot 110 on each corner of the sheet 105. The sheet is releasably coupled, via the adhesive spots 110, to a top surface of a sink 115. In this depiction, a user (not shown) has just shaven their beard over the sheet 105 attached the sink 115. As a result, hair-shavings 120 have collected on a top surface of the sheet 105. After a user has completed their shave, they may detach the sheet 105 from the sink 115, and wrap up the hair-shavings 120 in the sheet 105 to clean up the shaving mess. A user may then quickly and easily dispose of the sheet 105 along with the hair shavings 120, making cleanup of their shaving mess virtually effortless. Accordingly, the sheet 105 may eliminate the presence of any stray hair-shavings on the surface of the sink 115, which may save the user effort in clean up, and keep the sink 115 clean for future/subsequent use.

Figure 2A:
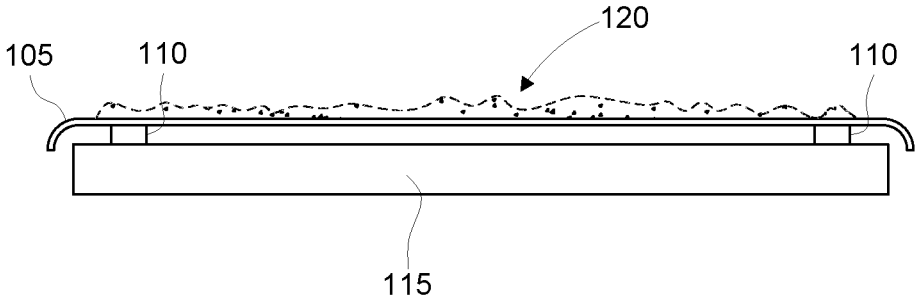
FIG. 2A depicts a cross-sectional view of an exemplary hair-shavings collecting sheet deployed on a bathroom sink.

FIG. 2A depicts a cross-sectional view of an exemplary hair-shavings collecting sheet deployed on a bathroom sink. The sheet 105 is releasably coupled to the sink 115 via the adhesive spots 110. Hair-shavings 120 have collected on a top surface of the sheet 105. After shaving a user may clean up by detaching the sheet 105 from the sink 115, and rolling up or crumpling the sheet 105 with the hair-shavings 120 being captured/enclosed by the sheet 105. The user may then dispose of the sheet 105 along with the captured/enclosed hair-shavings 120.

Figure 2B:
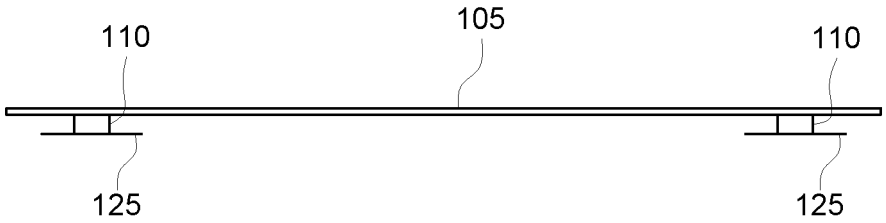
FIG. 2B depicts a cross-sectional view of an exemplary hair-shavings collecting sheet with release liners.

FIG. 2B depicts a cross-sectional view of an exemplary hair-shavings collecting sheet with release liners. Coupled to each adhesive spot 110 of the sheet 105 are respective release liners 125. A release liner 125 may be attached to an adhesive spot 105 in a manufacturing step, or before the sheet 105 is deployed. When the user wants to deploy the sheet 105, they may remove the release liner 125 and stick the adhesive to a surface (e.g., the top of a sink).

Figure 2C:
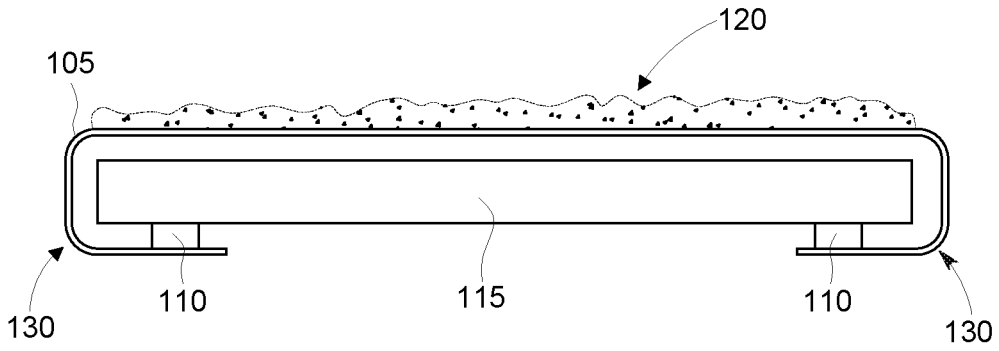
FIG. 2C depicts a cross-sectional view of an exemplary hair-shavings collecting sheet deployed on a bathroom sink, the sheet having preformed or spring-biased portions for attaching to the sink.

FIG. 2C depicts a cross-sectional view of an exemplary hair-shavings collecting sheet deployed on a bathroom sink, the sheet having preformed or spring-biased portions for attaching to the sink. A sheet 105 includes shaped edges 130. In some embodiments, the shaped edges 130 may be spring-biased to retain the shape of the edges when they are deformed. In this sense, the shaped edges 130 may be flexible (e.g., not rigid) as well as elastic (e.g., they may return to their original shape when an external distorting force is removed). In this example, adhesive spots 110 are disposed on a bottom inner surface of the shaped edges 130. This may allow for the sheet 105 to wrap around a surface (e.g., a top of a sink), thus increasing its coupling strength while preventing left-over adhesive on the top of the sink.

Figure 2D:
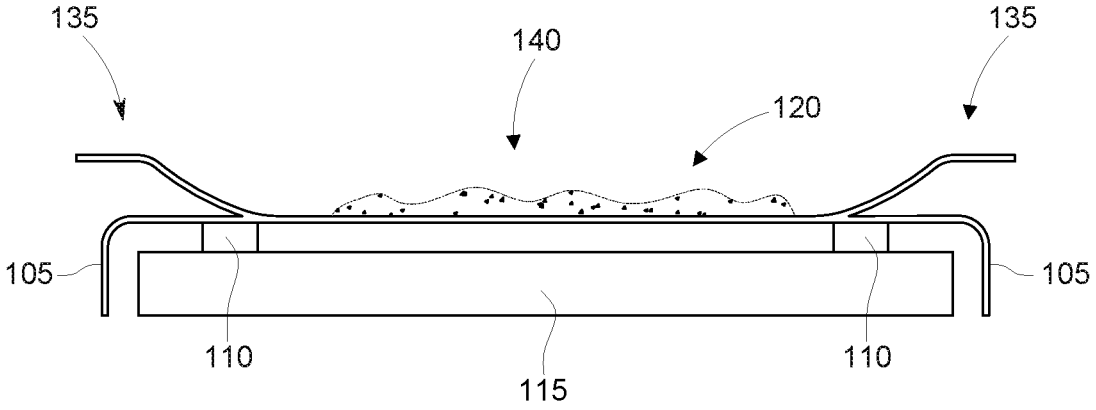
FIG. 2D depicts a cross-sectional view of an exemplary hair-shavings collecting sheet deployed on a bathroom sink, the sheet having upwardly shaped flaps that form a bowl or valley for hair-shavings to fall into.

FIG. 2D depicts a cross-sectional view of an exemplary hair-shavings collecting sheet deployed on a bathroom sink, the sheet having upwardly shaped flaps that form a bowl or valley for hair-shavings to fall into. A sheet 105 includes upwardly shaped flaps 135. The flaps 135 may be flexible and elastic, in some examples. The flaps 135 may form a bowl or a valley 140 of the sheet 105. The valley 140 may, in conjunction with the force of gravity, direct the shavings toward a central region of the sheet 105. This may advantageously provide for easier cleanup of the shavings 120 since they are concentrated in the top center of the sheet 105, as opposed to being more uniformly distributed over the top of the sheet 105. In some examples, the flaps 135 are integrally formed with the rest of the sheet 105.

Figure 3A:
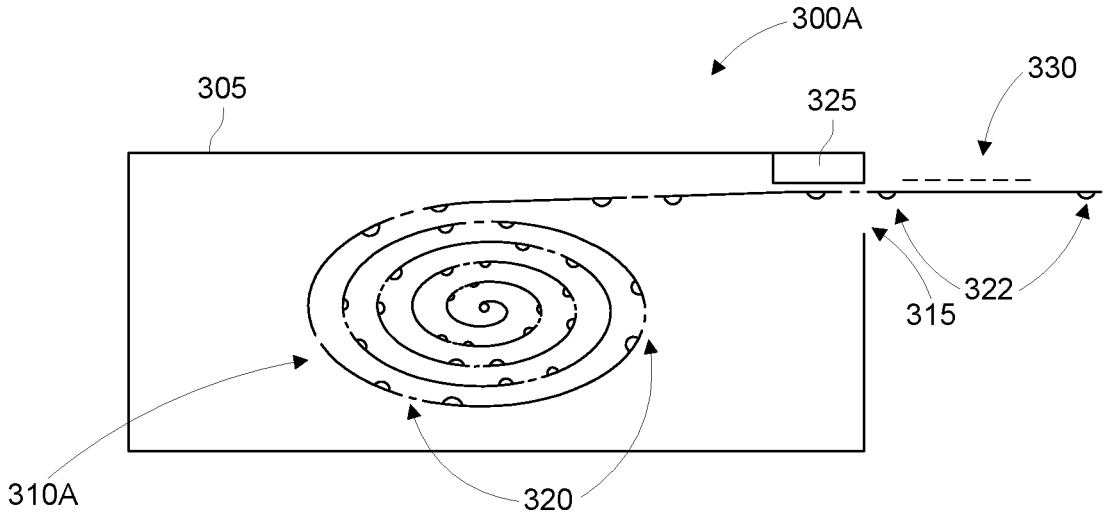
FIGS. 3A and 3B depicts side cross-sectional views of exemplary hair-shavings collecting sheet dispensers.
Figure 3B:
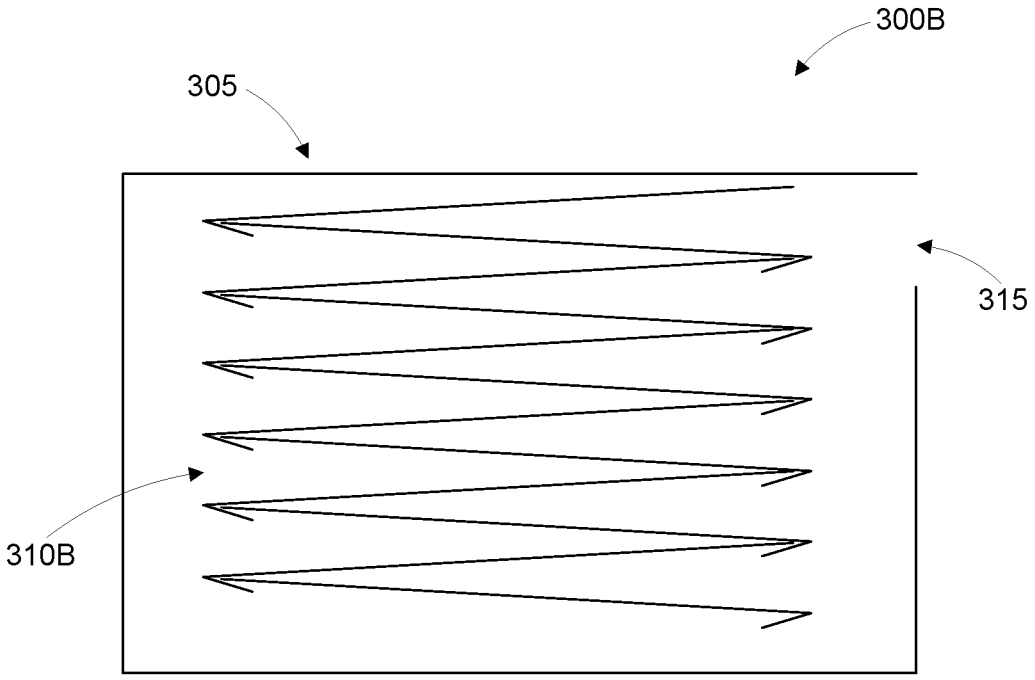

FIGS. 3A and 3B depicts side cross-sectional views of exemplary hair-shavings collecting sheet dispensers. A dispenser 300A includes a housing 305. The housing 305 houses a roll of hair-shavings collecting sheets 310A. The sheets 310A may be dispensed through an opening 315 in the housing 305. The sheets 310A are detachingly coupled to one another by perforations 320. Each sheet in the sheets 310A includes adhesive spots 322.

Included with the dispenser 300A is an electric charge imparter 325. The imparter 325 may be a frictional or rough surface with triboelectric charging properties (at least relative to the material that forms the sheets). When a user extracts a sheet from the dispenser 300A, the sheet may rub up against the imparter 325, which may cause electrons to be transferred between the sheet and the imparter 325. The redistribution of electrons on the sheet may cause the sheet to have a net non-zero electrical charge. In this example, the electrical exchange between the imparter and the sheet causes the sheet to have a nenegative charge 330. In some examples, the charge may be a net positive charge. A net non-zero electrical charge of the sheet may cause hair-shavings to be attracted to the sheet, which may advantageously allow for the sheet to collect more hair-shavings that may otherwise have not been collected. The charge imparted to the sheet may be about $10^1$, $10^2$, $10^3$, $10^4$, $10^5$, or about $10^6$ statcoulombs or more, for example.

A dispenser 300B includes a housing 305 that houses a stack of hair-shavings collecting sheets 310B. The sheets 310B may be dispensed through an opening 315 in the housing 305. When each sheet is dispensed, it may frictionally engage a neighboring sheet, thus resulting in triboelectric charging of the extracted sheet (e.g., similar to the triboelectric charging described above).

Although various embodiments have been described with reference to the Figures, other embodiments are possible. For example, the sheet may beneficially stay in place relative to an attachment surface due to adhesive. Some embodiments may allow for efficient trimming and shaving of body hair. In some examples, adhesive may be built in or integrated with each sheet. In some examples, the sheet may be a film. In various examples, the sheet may be formed of an (oxo-)biodegradable material. An oxo-biodegradable material may be a vegetable-based plastic that may be tested in accordance with ASTM D6400 or EN13432 to biodegrade in the conditions found in industrial composting or biogas facilities. In various examples, an oxo-biodegradable material may be a oxo-biodegradable plastic made from polymers, such as PE (polyethylene), PP (polypropylene), and PS (polystyrene) containing extra ingredients (metal salts) and tested according to ASTM D6954 or BS8472 or AFNOR Accord T51-808 to degrade and biodegrade in the open environment. The biodegradable film may have a thin consistency (e.g., similar to a small trashbag). In various examples, the sheets may be made of a recyclable material.

In various implementations, the sheet or film may act as a drape or a cover over a surface to prevent contamination by a user's hair-shavings. Some examples may include sheets that can be attached, stuck, or otherwise coupled to other sheets. In various examples, the sheets may be disposable. The sheets may be laid down before shaving and adhere to a surface, such as a sink, a counter, or a floor. Some sheets may include crease lines such that they may be folded together (see, e.g., FIG. 3B). Exemplary dimensions of a sheet may be about ½, 1, 1.5, 2, 2.5, or about 3.5 feet long or more, and about ½, 1, 1.5, 2, 2.5, or about 3.5 feet wide or more. In some examples, the shape of the sheets may be a non-rectangular shape.

A hair shavings collection and disposal system may include a pliable sheet (e.g., sheet 105) that may be unitarily formed of a deformable and oxo-biodegradable material. The pliable sheet may be defined as a sheet surface having a first side, a second side, a longitudinal length, a lateral width, and a vertical thickness. The pliable sheet may include a first edge extending along the longitudinal length, a second edge extending along the longitudinal length and laterally opposed to the first edge, a third edge extending along the lateral width, a fourth edge extending along the lateral width and longitudinally opposed to the third edge. The hair shavings collection and disposal system may include two or more adhesive masses (e.g., adhesive spots 110) that may be individually disposed on at least one of the first and second sides of the sheet surface defining the pliable sheet. The adhesive masses may be configured to adhesively and releasably couple the pliable sheet to a sink surface (e.g., sink 115). The adhesive masses may include a right-side adhesive mass located at a right lateral end of the pliable sheet, and a left-side adhesive mass located at a left lateral end of the pliable sheet and laterally opposed to the right-side adhesive mass.

The hair shavings collection and disposal system may further include two or more release liners (e.g., release liners 125) each physically and removably coupled with an associated adhesive mass. In some examples, at least one of the first, second, third, and fourth edges may include a pre-shaped edge (e.g., shaped edge 130) dimensioned to wrap at least a portion of the pliable sheet around a peripheral edge of the sink surface. The hair shavings collection and disposal system may further include at least one flap (e.g., flap 135) that may be operably attached to, and may extend vertically away from, at least one of the first and second sides of the sheet surface defining the pliable sheet. The at least one flap may define a valley (e.g., bowl/valley 140) configured to collect hair shavings when the pliable sheet is deployed on the sink surface.

The hair shavings collection and disposal system may further include a dispenser (e.g., dispensers 300A, 300B). The dispenser may include a housing (e.g., housing 305) that houses at least one pliable sheet. The dispenser may include an opening (e.g., opening 315) through which the pliable sheet is configured to be dispensed. The dispenser may include, in some embodiments, an electrical charge imparter (e.g., imparter 325) operably coupled to the housing. The imparter may be or have a frictional engagement surface configured to frictionally engage, and impart a non-zero electrical charge to, the pliable sheet as the pliable sheet is dispensed from the housing, such that once the pliable sheet is dispensed from the dispenser, the pliable sheet is configured to electrically attract and retainingly couple human hair-shavings to the pliable sheet. The non-zero electrical charge imparted to the pliable sheet, may, in some embodiments, be at least $10^1$ statcoulombs after the pliable sheet frictionally engages with the frictional engagement surface once the pliable sheet is dispensed from the dispenser. The non-zero electrical charge imparted to the pliable sheet may be sufficient to retain human hair shavings against the force of gravity at the surface of the Earth surface. For example, if a single human hair has a mass of about 0.5 milligrams, a single hair shaving is about 10% of the length/mass of a human hair, and the force of gravity at Earth's surface is about 9.8 meters per second squared, then (using the equation F=m*a), the force of gravity $F_g$ at Earth's surface on this single exemplary human hair shaving would be $F_g$=(0.0005 grams)*(0.1)*(9.8 meters per second squared)=0.00049 Newtons. Therefore, the manufacture of the hair shavings collection and disposal system may calibrate the electrical charge imparted to a pliable sheet by the imparter to be sufficient for the attraction force between the electrically charged sheet and an individual human hair shaving to overcome not just the force of gravity $F_g$, but several magnitudes greater than $F_g$ (to account for additional forces, such as shaking of the sheet, for example).

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated. A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A hair shavings collection and disposal system consisting of:

a pliable sheet (105) that is: (1) unitarily formed of a deformable and oxo-biodegradable polymer material, and (2) defined as a solid sheet surface having a first side, a second side, a longitudinal length, a lateral width, and a vertical thickness, the pliable sheet comprising:

a first edge extending along the longitudinal length;

a second edge extending along the longitudinal length and laterally opposed to the first edge;

a third edge extending along the lateral width;

a fourth edge extending along the lateral width and longitudinally opposed to the third edge; and, a plurality of adhesive masses (110) that are: (1) individually disposed on the second side of the sheet surface defining the pliable sheet, and (2) configured to adhesively and releasably couple the pliable sheet to a sink surface, the plurality of adhesive masses comprising:

a right-side adhesive mass disposed at a right lateral end of the pliable sheet; and, a left-side adhesive mass disposed at a left lateral end of the pliable sheet and laterally opposed to the right-side adhesive mass; and, a dispenser (300A, 300B) comprising:

a housing (305) that houses the pliable sheet; and, an opening (315) through which the pliable sheet is configured to be dispensed, wherein the pliable sheet is provided with a net non-zero electric charge at least on the second side such that the second side is configured to attract and retainingly couple hair clippings to the second side with an electrostatic force greater than a force on the hair clippings due to gravity.

2. The hair shavings collection and disposal system of claim 1, further consisting of a plurality of release liner (125) each physically and removably coupled with an associated adhesive mass in the plurality of adhesive masses.

3. The hair shavings collection and disposal system of claim 1, wherein at least one of the first, second, third, and fourth edges comprises a pre-shaped edge (130) dimensioned to wrap at least a portion of the pliable sheet around a peripheral edge of the sink surface.

4. The hair shavings collection and disposal system of claim 1, the pliable sheet further consisting of at least one flap (135) that is operably attached to, and extends vertically away from, at least one of the first and second sides of the sheet surface defining the pliable sheet, the at least one flap defining a valley (140) configured to collect hair shavings when the pliable sheet is deployed on the sink surface.

5. The hair shavings collection and disposal system of claim 1, wherein the oxo-biodegradable material comprises a vegetable-based plastic.

6. The hair shavings collection and disposal system of claim 1, wherein the dispenser further comprises an electrical charge imparter (325) operably coupled to the housing and comprising a frictional engagement surface configured to frictionally engage, and impart a non-zero electrical charge to, the pliable sheet as the pliable sheet is dispensed from the housing, such that once the pliable sheet is dispensed from the dispenser, the pliable sheet is configured to electrically attract and retainingly couple human hair-shavings to the pliable sheet.

7. The hair shavings collection and disposal system of claim 6, wherein the non-zero electrical charge imparted to the pliable sheet is at least $10^1$ statcoulombs after the pliable sheet frictionally engages with the frictional engagement surface once the pliable sheet is dispensed from the dispenser.

8. The hair shavings collection and disposal system of claim 6, wherein the non-zero electrical charge imparted to the pliable sheet is sufficient to retain human hair shavings against the force of gravity at the surface of the Earth surface.

9. A hair shavings collection and disposal system, consisting of:

a pliable sheet (105) that is: (1) unitarily formed of a deformable and oxo-biodegradable polymer material, and (2) defined as a solid sheet surface having a first side, a second side, a longitudinal length, a lateral width, and a vertical thickness, the pliable sheet comprising:

a first edge extending along the longitudinal length;

a second edge extending along the longitudinal length and laterally opposed to the first edge;

a third edge extending along the lateral width; and, a fourth edge extending along the lateral width and longitudinally opposed to the third edge; and, a plurality of adhesive masses (110) that are: (1) individually disposed on the first side of the sheet surface defining the pliable sheet, and (2) configured to adhesively and releasably couple the pliable sheet to a sink surface, the plurality of adhesive masses comprising:

a right-side adhesive mass disposed at a right lateral end of the pliable sheet; and, a left-side adhesive mass disposed at a left lateral end of the pliable sheet and laterally opposed to the right-side adhesive mass, wherein the pliable sheet is provided with a net non-zero electric charge at least on the second side such that the second side is configured to attract and retainingly couple hair clippings to the second side with an electrostatic force greater than a force on the hair clippings due to gravity.

10. The hair shavings collection and disposal system of claim 9, further consisting of comprising a plurality of release liners (125) each physically and removably coupled with an associated adhesive mass in the plurality of adhesive masses.

11. The hair shavings collection and disposal system of claim 9, wherein at least one of the first, second, third, and fourth edges comprises a pre-shaped edge (130) dimensioned to wrap at least a portion of the pliable sheet around a peripheral edge of the sink surface.

12. The hair shavings collection and disposal system of claim 9, further consisting of comprising at least one flap (135) that is operably attached to, and extends vertically away from, at least one of the first and second sides of the sheet surface defining the pliable sheet, the at least one flap defining a valley (140) configured to collect hair shavings when the pliable sheet is deployed on the sink surface.

13. The hair shavings collection and disposal system of claim 9, wherein the oxo-biodegradable material comprises a vegetable-based plastic.

14. A hair shavings collection and disposal system consisting of:

a pliable sheet (105) that is: (1) unitarily formed of a deformable and oxo-biodegradable material, and (2) defined as a sheet surface having a first side, a second side, a longitudinal length, a lateral width, and a vertical thickness, the pliable sheet comprising:

a first edge extending along the longitudinal length;

a second edge extending along the longitudinal length and laterally opposed to the first edge;

a third edge extending along the lateral width; and, a fourth edge extending along the lateral width and longitudinally opposed to the third edge; and, a plurality of means for adhering (110) that are: (1) individually disposed on at least one of the first and second sides of the sheet surface defining the pliable sheet, and (2) configured to adhesively and releasably couple the pliable sheet to a sink surface, the plurality of means for adhering comprising:

a right-side means for adhering disposed at a right lateral end of the pliable sheet; and, a left-side means for adhering disposed at a left lateral end of the pliable sheet and laterally opposed to the right-side means for adhering, wherein the pliable sheet is provided with a net non-zero electric charge at least on the second side such that the second side is configured to attract and retainingly couple hair clippings to the second side with an electrostatic force greater than a force on the hair clippings due to gravity.

15. The hair shavings collection and disposal system of claim 14, further consisting of a plurality of release liners (125) each physically and removably coupled with an associated adhesive mass in the plurality of means for adhering.

16. The hair shavings collection and disposal system of claim 14, wherein at least one of the first, second, third, and fourth edges comprises a pre-shaped edge (130) dimensioned to wrap at least a portion of the pliable sheet around a peripheral edge of the sink surface.

17. The hair shavings collection and disposal system of claim 14, further consisting of at least one flap (135) that is operably attached to, and extends vertically away from, at least one of the first and second sides of the sheet surface defining the pliable sheet, the at least one flap defining a valley (140) configured to collect hair shavings when the pliable sheet is deployed on the sink surface.

18. The hair shavings collection and disposal system of claim 14, wherein the oxo-biodegradable material comprises a vegetable-based plastic.

* * * * *